US010565914B2

(12) United States Patent
Kang

(10) Patent No.: US 10,565,914 B2
(45) Date of Patent: Feb. 18, 2020

(54) SCAN DRIVER AND DISPLAY DEVICE INCLUDING THE SAME

(71) Applicant: SAMSUNG DISPLAY CO., LTD., Yongin-si, Gyeonggi-do (KR)

(72) Inventor: Hyung-Ryul Kang, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 116 days.

(21) Appl. No.: 15/093,516

(22) Filed: Apr. 7, 2016

(65) Prior Publication Data

US 2017/0084237 A1 Mar. 23, 2017

(30) Foreign Application Priority Data

Sep. 21, 2015 (KR) ..... 10-2015-0132947

(51) Int. Cl.

| | |
|---|---|
| ***G09G 3/20*** | (2006.01) |
| *G09G 3/36* | (2006.01) |
| *G09G 3/3266* | (2016.01) |

(52) U.S. Cl.

CPC ..... *G09G 3/20* (2013.01); *G09G 3/3266* (2013.01); *G09G 3/3674* (2013.01); *G09G 3/3677* (2013.01)

(58) Field of Classification Search

CPC ... G09G 3/3674; G09G 3/3677; G09G 3/3266
USPC ..... 345/204
See application file for complete search history.

(56) References Cited

U.S. PATENT DOCUMENTS

| | | | | |
|---|---|---|---|---|
| 4,198,700 | A * | 4/1980 | Aoyama | G11C 11/408 326/106 |
| 8,354,979 | B2 * | 1/2013 | Chung | G09G 3/3266 326/104 |
| 9,047,821 | B2 | 6/2015 | Kim et al. | |
| 9,171,505 | B2 * | 10/2015 | Lee | G09G 3/3266 |
| 2006/0038767 | A1 * | 2/2006 | Nakamura | G09G 3/3677 345/100 |
| 2006/0244699 | A1 * | 11/2006 | Yamazaki | G09G 3/3233 345/82 |
| 2008/0036497 | A1 * | 2/2008 | Chung | G09G 3/3266 326/83 |
| 2008/0143659 | A1 * | 6/2008 | Ma | G09G 3/3677 345/87 |

FOREIGN PATENT DOCUMENTS

| | | | |
|---|---|---|---|
| KR | 10-2009-0055147 | A | 6/2009 |
| KR | 10-1107163 | B1 | 1/2012 |

* cited by examiner

*Primary Examiner* — Yuzhen Shen
(74) *Attorney, Agent, or Firm* — Lewis Roca Rothgerber Christie LLP

(57) ABSTRACT

A scan driver includes a plurality of signal lines configured to transfer a scan line selection signal for selecting a target scan line among a plurality of scan lines, and a plurality of logical elements respectively connected to some or all of a plurality of signal line groups respectively including grouped ones of the signal lines based on a combination calculation, the plurality of logical elements being respectively connected to the scan lines, and being configured to provide output signals to the scan lines, wherein a number of the signal line groups is greater than, or equal to, a number of the logical elements.

8 Claims, 10 Drawing Sheets

FIG. 6

| PRIOR ART | | | THIS EMBODIMENT | | |
|---|---|---|---|---|---|
| THE NUMBER OF SIGNAL-LINES | THE NUMBER OF INPUTS | THE NUMBER OF MAXIMUM SCAN-LINES | THE NUMBER OF SIGNAL-LINES | THE NUMBER OF INPUTS | THE NUMBER OF MAXIMUM SCAN-LINES |
| 16(4,4,4,4) | 4 | 256 | 10 | 4 | 210 |
| 17(5,4,4,4) | 4 | 320 | 11 | 4 | 330 |
| 18(5,5,4,4) | 4 | 400 | 12 | 4 | 495 |
| 19(5,5,5,4) | 4 | 500 | 13 | 4 | 715 |
| 20(5,5,5,5) | 4 | 625 | 14 | 4 | 1001 |
| 21(6,5,5,5) | 4 | 750 | 15 | 4 | 1365 |
| 22(6,6,5,5) | 4 | 900 | 16 | 4 | 1820 |

SCAN DRIVER AND DISPLAY DEVICE INCLUDING THE SAME

CROSS-REFERENCE TO RELATED APPLICATION(S)

This application claims priority to, and the benefit of, Korean Patent Application No. 10-2015-0132947, filed on Sep. 21, 2015 in the Korean Intellectual Property Office (KIPO), the contents of which are incorporated herein in its entirety by reference.

BACKGROUND

1. Field

Example Embodiments (e.g., example embodiments of the present invention) relate generally to a display device including a scan driver.

2. Description of the Related Art

Generally, a display device includes a display panel, a scan driver, a data driver, a timing controller, and the like. Conventionally, a scan driver that sequentially provides a scan signal to the display panel through scan lines (i.e., a sequential scan driving technique) has been mainly used in displays. Recently, a scan driver that randomly provides a scan signal to the display panel through scan lines (i.e., a random scan driving technique) has received attention in the research of displays. The scan driver employing the random scan driving technique is usually implemented by a decoder-type internal circuit.

For example, the scan driver employing the random scan driving technique may have a structure in which signal lines connected to logical elements (e.g., OR-gate elements), which are correspondingly connected to the scan lines, are grouped into a plurality of signal line groups, and one signal line selected from each signal line group is connected to inputs of one logical element. However, in such a structure, because a structure of selecting two or more signal lines from one signal line group is excluded, the number of signal lines is unnecessarily increased. In addition, because the number of signal lines, which are located in a non-display region of a display device that is where the signal lines, a black matrix (BM), and the like are formed (i.e., a region other than a display region of the display device), increases as resolution of the display device increases, a dead space of the display device also increases, or becomes wider.

SUMMARY

Some embodiments of the present invention provide a scan driver that can reduce a dead space of a display device by reducing or minimizing the number of signal lines located in a non-display region of the display device, where the scan driver is implemented by a decoder-type internal circuit.

Some example embodiments provide a display device having a slim black matrix (BM) structure by including the scan driver.

According to some example embodiments, a scan driver includes a plurality of signal lines configured to transfer a scan line selection signal for selecting a target scan line among a plurality of scan lines, and a plurality of logical elements respectively connected to some or all of a plurality of signal line groups respectively including grouped ones of the signal lines based on a combination calculation, the plurality of logical elements being respectively connected to the scan lines, and being configured to provide output signals to the scan lines, wherein a number of the signal line groups is greater than, or equal to, a number of the logical elements.

A number of the signal lines may correspond to a combination formula $qCr \geq n$, wherein q denotes the number of the signal lines, wherein n denotes a number of the scan lines or the number of the logical elements, and wherein r denotes a number of inputs of each of the logical elements.

The scan line selection signal may include q bits, the signal lines may be configured to transfer the q bits, and each of the logical elements may be configured to generate each of the output signals by performing a logical operation on r bits transferred from each of the signal line groups.

The logical elements may include OR-gate elements, a corresponding scan line of the scan lines connected to a corresponding logical element of the logical elements may be configured to be selected when a corresponding output signal of the output signals of the corresponding logical element includes a binary digit "0," and the corresponding scan line may be configured to be not selected when the corresponding output signal includes a binary digit "1".

The q bits of the scan line selection signal may be configured to be changed to sequentially drive the scan lines, or to randomly drive the scan lines.

According to some example embodiments, a display device includes a display panel, a scan driver configured to provide a scan signal to the display panel via a plurality of scan lines, a data driver configured to provide a data signal to the display panel via a plurality of data lines in response to the scan signal, and a timing controller configured to control the scan driver and the data driver, wherein the scan driver includes a plurality of signal lines configured to transfer a scan line selection signal for selecting a target scan line among the scan lines, and a plurality of logical elements respectively connected to some or all of a plurality of signal line groups including grouped ones of the signal lines based on a combination calculation, the plurality of logical elements being respectively connected to the scan lines, and being configured to provide output signals to the scan lines as the scan signal, and wherein a number of the signal line groups is greater than or equal to a number of the logical elements.

A number of the signal lines may correspond to a combination formula $qCr \geq n$, wherein q denotes the number of the signal lines, wherein n denotes a number of the scan lines or the number of the logical elements, and wherein r denotes a number of inputs of each of the logical elements.

The scan line selection signal may include q bits, the signal lines may be configured to transfer the q bits, and each of the logical elements may be configured to generate a corresponding output signal of the output signals by performing a logical operation on r bits transferred from a corresponding signal line group of the signal line groups.

The logical elements may include OR-gate elements, a corresponding scan line of the scan lines that is connected to a corresponding logical element of the logical elements may be configured to be selected when the corresponding output signal of the corresponding logical element includes a binary digit "0," and the corresponding scan line may be configured to be not selected when the corresponding output signal includes a binary digit "1".

The q bits of the scan line selection signal may be configured to be changed to sequentially drive the scan lines, or to randomly drive the scan lines.

According to some example embodiments, a display device includes a display panel including an upper display region and a lower display region, an upper scan driver configured to provide an upper scan signal to the upper display region via a plurality of upper scan lines, a lower scan driver configured to provide a lower scan signal to the lower display region via a plurality of lower scan lines, a data driver configured to provide a data signal to the display panel via a plurality of data lines in response to the upper scan signal and the lower scan signal, and a timing controller configured to control the upper scan driver, the lower scan driver, and the data driver, wherein the upper scan driver includes a plurality of upper signal lines configured to transfer an upper scan line selection signal for selecting a target upper scan line among the upper scan lines, and a plurality of upper logical elements respectively connected to some or all of a plurality of upper signal line groups including grouped ones of the upper signal lines based on a combination calculation, the plurality of upper logical elements being respectively connected to the upper scan lines, and being configured to provide upper output signals to the upper scan lines as the upper scan signal, wherein the lower scan driver includes a plurality of lower signal lines configured to transfer a lower scan line selection signal for selecting a target lower scan line among the lower scan lines, and a plurality of lower logical elements correspondingly connected to some or all of a plurality of lower signal line groups including grouped ones of the lower signal lines based on combination calculation, the plurality of lower logical elements being respectively connected to the lower scan lines, and being configured to provide lower output signals to the lower scan lines as the lower scan signal, and wherein a number of the upper signal line groups is greater than, or equal to, a number of the upper logical elements, and a number of the lower signal line groups is greater than, or equal to, a number of the lower logical elements.

The number of the upper signal lines may correspond to a combination formula $q_1Cr_1 \geq n1$, wherein q1 denotes the number of the upper signal lines, wherein n1 denotes the number of upper scan lines or the number of the upper logical elements, and wherein r1 denotes a number of inputs of each of the upper logical elements.

The number of the lower signal lines may correspond to a combination formula $q_2Cr_2 \geq n2$, wherein q2 denotes the number of the lower signal lines, wherein n2 denotes a number of the lower scan lines or the number of the lower logical elements, and wherein r2 denotes a number of inputs of each of the lower logical elements.

The number of the upper scan lines may be equal to the number of the lower scan lines, and the number of the upper signal lines may be equal to the number of the lower signal lines.

The number of the upper scan lines may be different from the number of the lower scan lines, and the number of the upper signal lines may be different from the number of the lower signal lines.

The upper scan line selection signal may include q1 bits, the upper signal lines may be configured to transfer the q1 bits, and each of the upper logical elements may be configured to generate each of the upper output signals by performing a logical operation on r1 bits transferred from each of the upper signal line groups.

The lower scan line selection signal may include q2 bits, the lower signal lines may be configured to transfer the q2 bits, and each of the lower logical elements may be configured to generate each of the lower output signals by performing a logical operation on r2 bits transferred from each of the lower signal line groups.

The upper logical elements may include OR-gate elements, a corresponding upper scan line of the upper scan lines that is connected to a corresponding upper logical element of the upper logical elements may be configured to be selected when the upper output signal of the upper logical element includes a binary digit "0," and the corresponding upper scan line may be configured to be not selected when the upper output signal of the upper logical element includes a binary digit "1".

The lower logical elements may include OR-gate elements, a corresponding lower scan line of the lower scan lines that is connected to a corresponding lower logical element of the lower logical elements may be configured to be selected when the lower output signal of the lower logical element includes a binary digit "0," and the corresponding lower scan line may be configured to be not selected when the lower output signal of the lower logical element includes a binary digit "1".

The q1 bits of the upper scan line selection signal and the q2 bits of the lower scan line selection signal may be configured to be changed to sequentially drive the upper scan lines and the lower scan lines, or to randomly drive the upper scan lines and the lower scan lines, respectively.

Therefore, a scan driver according to example embodiments may be implemented by a decoder-type internal circuit having a structure in which q signal lines exist, where q is a minimum integer value that satisfies a combination formula $qCr \geq n$ (here, q denotes the number of signal lines, n denotes the number of scan lines, and r denotes the number of inputs of each logical element), and in which some or all of the signal lines are correspondingly connected to logical elements that are correspondingly connected to the scan lines. As a result, the scan driver may efficiently reduce a dead space of a display device by reducing or minimizing the number of signal lines located in a non-display region of the display device.

In addition, a display device according to example embodiments may have a slim BM structure by including the scan driver.

BRIEF DESCRIPTION OF THE DRAWINGS

Illustrative, non-limiting example embodiments will be more clearly understood from the following detailed description, taken in conjunction with the accompanying drawings, in which:

FIGS. 4 through 6 are diagrams for comparing a conventional scan driver with a scan driver included in the display device of FIG. 1;

DETAILED DESCRIPTION

Figure 1:
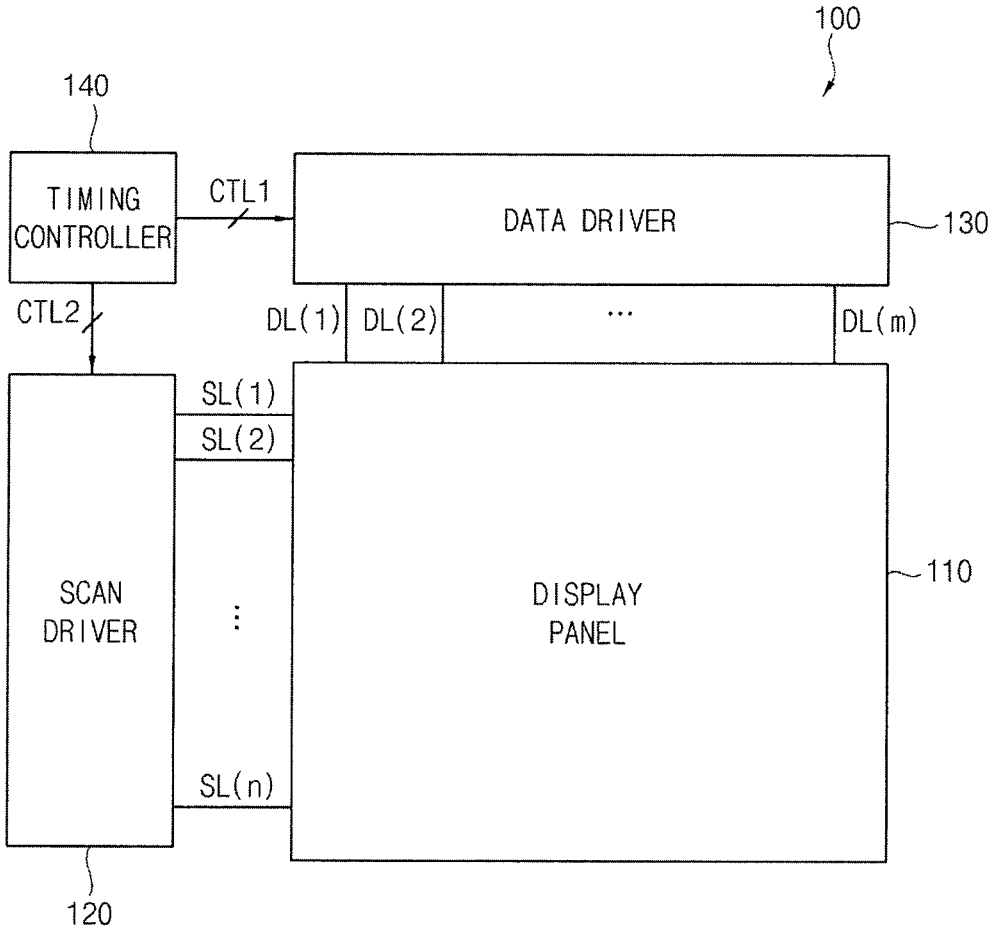
FIG. 1 is a block diagram illustrating a display device according to example embodiments.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
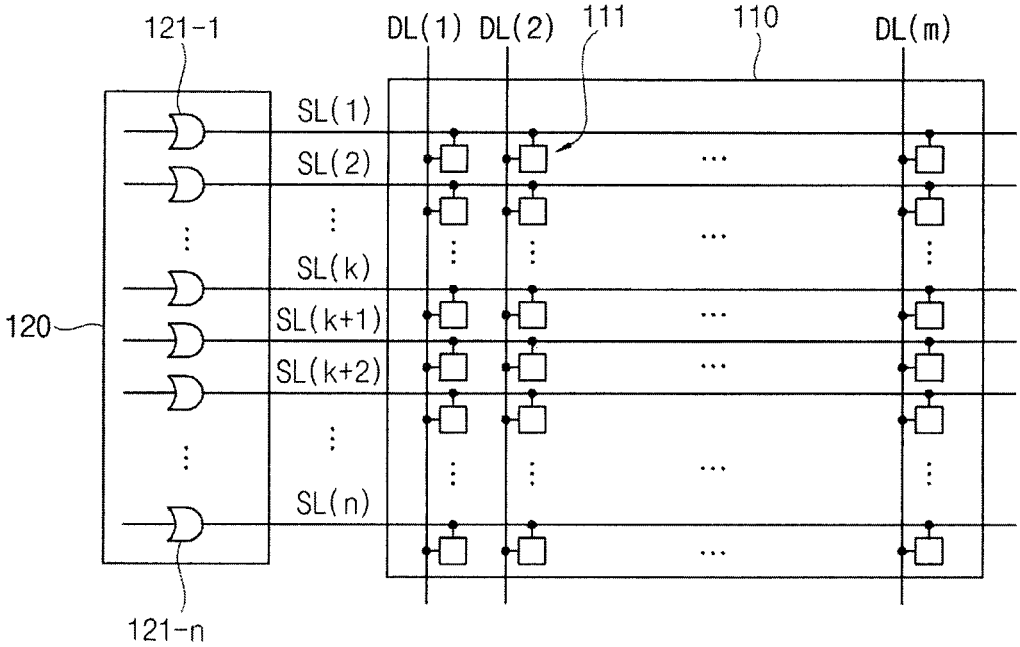
FIG. 2 is a diagram illustrating an example in which a display panel is connected to a scan driver in the display device of FIG. 1.
Figure 3:
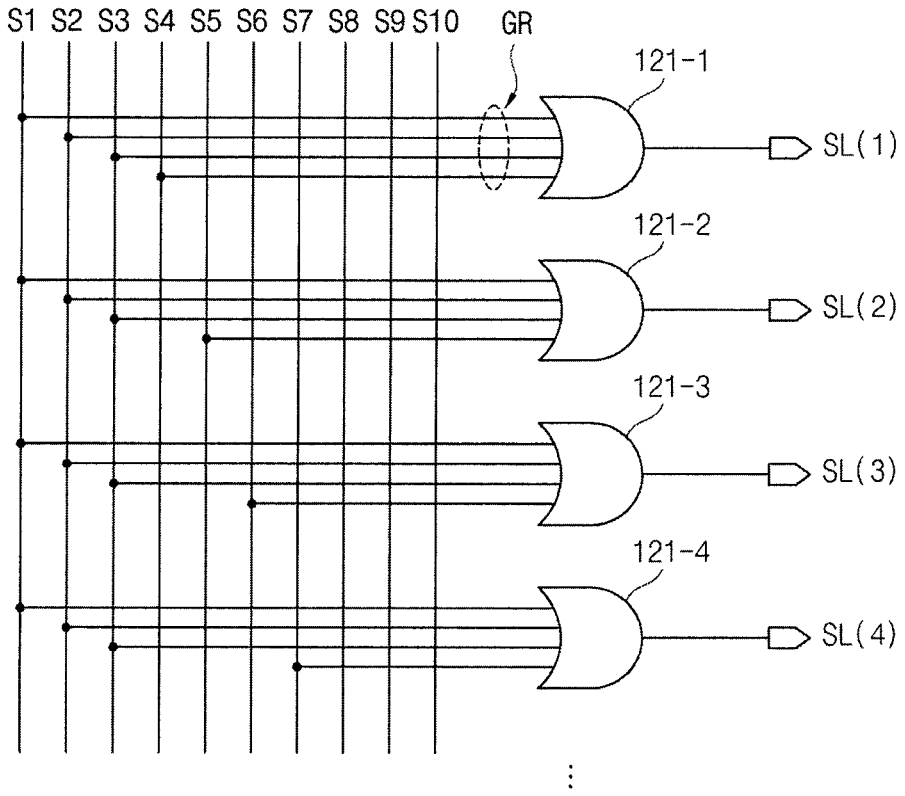
FIG. 3 is a diagram illustrating a scan driver included in the display device of FIG. 1.

FIG. 1 is a block diagram illustrating a display device according to example embodiments, FIG. 2 is a diagram illustrating an example in which a display panel is connected to a scan driver in the display device of FIG. 1, and FIG. 3 is a diagram illustrating a scan driver included in the display device of FIG. 1.

Referring to FIGS. 1 through 3, the display device 100 may include a display panel 110, a scan driver 120, a data driver 130, and a timing controller 140. In an example embodiment, the display device 100 may be an organic light emitting display device of which the display panel 110 includes a pixel circuit 111 (see FIG. 2) including an organic light emitting diode (OLED). In another example embodiment, the display device 100 may be a liquid crystal display device of which the display panel 110 includes a pixel circuit 111 including a liquid crystal layer. However, the display device 100 is not limited thereto.

The display panel 110 may include a plurality of pixel circuits 111. The scan driver 120 may provide a scan signal to the display panel 110 through scan lines SL(1) through SL(n), where n is an integer that is greater than or equal to 2. The data driver 130 may provide a data signal to the display panel 110 through data lines DL(1) through DL(m) in response to the scan signal, where m is an integer greater than or equal to 2. The timing controller 140 may control the data driver 130 and the scan driver 120 by generating and providing control signals CTL1 and CTL2 to the data driver 130 and the scan driver 120, respectively. Here, the control signal CTL2 that the timing controller 140 provides to the scan driver 120 may include a scan line selection signal for selecting one target scan line among the scan lines SL(1) through SL(n).

In some example embodiments, the display device 100 may further include other components. For example, the display device 100 may further include an emission control driver and/or the like when the display device 100 is an organic light emitting display device. For example, the display device 100 may further include a backlight and/or the like when the display device 100 is the liquid crystal display device. Although it is illustrated in FIG. 1 that the scan driver 120, the data driver 130, and the timing controller 140 are separated from each other, in some example embodiments, the scan driver 120, the data driver 130, and the timing controller 140 may be integrated into a single component in the display device 100. Thus, the scan driver 120, the data driver 130, and the timing controller 140 may be interpreted as functions of at least one peripheral circuit connected to the display panel 110. For example, the timing controller 140 may perform operations of the scan driver 120 and the data driver 130, or may include at least one component that performs the operations of the scan driver 120 and the data driver 130.

As illustrated in FIGS. 2 and 3, the scan driver 120 may include signal lines S1 through S10 (see FIG. 3) and logical elements 121-1 through **121-*n*. In addition, as illustrated in FIG. 2, the logical elements 121-1 through 121-*n* of the scan driver 120 may be correspondingly connected to the scan lines SL(1) through SL(n). For example, the first logical element 121-1 may be connected to the first scan line SL(1), the second logical element 121-2 may be connected to the second scan line SL(2), and the (n)th logical element 121-*n*** may be connected to the (n)th scan line SL(n).

For convenience of description, only ten signal lines S1 through S10, only four logical elements 121-1 through 121-4, and only four scan lines SL(1) through SL(4) are illustrated in FIG. 3. The signal lines S1 through S10 may transfer the scan line selection signal for selecting one target scan line among the scan lines SL(1) through SL(n). The logical elements 121-1 through **121-*n* may be correspondingly connected to some or all of signal line groups GR by which the signal lines S1 through S10 are grouped based on a combination calculation. The logical elements 121-1 through 121-*n* may be respectively connected to the scan lines SL(1) through SL(n). Thus, the logical elements 121-1 through 121-*n* may respectively provide an output signal to the scan lines SL(1**) through SL(n) as the scan signal.

Here, because the scan driver 120 is required to drive all scan lines SL(1) through SL(n) of the display device 100, the number of the signal line groups GR may be greater than or equal to the number of the logical elements 121-1 through **121-*n*, as each group is connected to a respective one of the logical elements 121-1 through 121-*n*. That is, when the number of the signal line groups GR is greater than the number of the logical elements 121-1 through 121-*n*, the scan driver 120 can drive all scan lines SL(1) through SL(n) of the display device 100 without using some of the signal line groups GR. However, when the number of the signal line groups GR is smaller than the number of the logical elements 121-1 through 121-*n*, the scan driver 120 cannot drive some of the scan lines SL(1) through SL(n) of the display device 100. For this reason, the number of the signal line groups GR may be greater than or equal to the number of the logical elements 121-1 through 121-*n***.

For example, in the scan driver 120, the number of the signal lines S1 through S10 may be a minimum value q that satisfies a combination formula $qCr \geq n$, where q denotes the number of the signal lines S1 through S10, n denotes the number of the scan lines SL(1) through SL(n) or the number of the logical elements 121-1 through **121-*n*, and r denotes the number of inputs of each of the logical elements 121-1 through 121-*n***.

For example, when the number of the scan lines SL(1) through SL(n) is 200, and when the number of the inputs of each of the logical elements 121-1 through **121-*n*** is 4, the minimum value q that satisfies a combination formula $qC4 \geq 200$ can be obtained. In this case, because qC4 is 126 when q is 9, and because qC4 is 210 when q is 10, the minimum value q may be determined to be 10.

Similarly, when the number of the scan lines SL(1) through SL(n) is 256, and when the number of the inputs of each of the logical elements 121-1 through **121-*n*** is 4, the minimum value q that satisfies a combination formula $qC4 \geq 256$ can be obtained. In this case, because qC4 is 210 when q is 10 and qC4 is 330 when q is 11, the minimum value q may be determined to be 11.

In a conventional scan driver, a plurality of signal lines are grouped into a plurality of signal line groups, and one signal line selected from each signal line group is connected to inputs of one logical element. Thus, when the number of scan lines SL(1) through SL(n) is 256, and when the number of inputs of each of the logical elements 121-1 through **121-*n* is 4, 16 signal lines (i.e., 4+4+4+4=16) are required because 4×4×4×4=256 is calculated. As a result, under the same condition, the conventional scan driver requires 16 signal lines, while the scan driver 120 of the embodiment of the present invention described above requires only 11 signal lines. Thus, the display device 100 including the scan driver 120** may have a BM structure that is improved by more than 30% when compared to a BM structure of a display device including the conventional scan driver.

The scan line selection signal may include q bits. The signal lines S1 through S10 may transfer the q bits. Each of the logical elements 121-1 through **121-*n* may generate the output signal by performing a logical operation on r bits transferred from each signal line group GR. That is, as illustrated in FIG. 3, when the number of the signal lines S1 through S10 is 10, the scan line selection signal may include 10 bits, and each of the 10 bits may be transferred via each of the signal lines S1 through S10. In addition, each of the logical elements 121-1 through 121-*n*** may receive 4 bits to perform a logical operation on the received 4 bits.

For example, the first logical element 121-1 may be connected to the first signal line S1, the second signal line S2, the third signal line S3, and the fourth signal line S4 to perform a logical operation on 4 bits transferred via the first signal line S1, the second signal line S2, the third signal line S3, and the fourth signal line S4. The second logical element 121-2 may be connected to the first signal line S1, the second signal line S2, the third signal line S3, and the fifth signal line S5 to perform a logical operation on 4 bits transferred via the first signal line S1, the second signal line S2, the third signal line S3, and the fifth signal line S5. The third logical element 121-3 may be connected to the first signal line S1, the second signal line S2, the third signal line S3, and the sixth signal line S6 to perform a logical operation on 4 bits transferred via the first signal line S1, the second signal line S2, the third signal line S3, and the sixth signal line S6. The fourth logical element 121-4 may be connected to the first signal line S1, the second signal line S2, the third signal line S3, and the seventh signal line S7 to perform a logical operation on 4 bits transferred via the first signal line S1, the second signal line S2, the third signal line S3, and the seventh signal line S7. Thus, the scan lines SL(1) through SL(n) may be driven based on the output signals (i.e., the scan signals) generated by the logical elements 121-1 through **121-*n***.

In an example embodiment, as illustrated in FIG. 3, the logical elements 121-1 through **121-*n* may be OR-gate elements. In this case, when an output signal of one of the logical element—121-1 through 121-*n* has a binary digit "0," a corresponding one of the scan lines SL(1) through SL(n) connected to the logical element 121-1 through 121-*n* may be selected by the scan driver 120**.

On the other hand, when an output signal of one of the logical elements 121-1 through **121-*n* has a binary digit "1," a corresponding one of the scan lines SL(1) through SL(n) connected to the logical element 121-1 through 121-*n* may not be selected by the scan driver 120. For example, when the first logical element 121-1 receives 4 bits including binary digits "0," "0," "0," and "0" from the first signal line S1, the second signal line S2, the third signal line S3, and the fourth signal line S4, which constitute a signal line group GR connected to the first logical element 121-1, the first logical element 121-1 may output an output signal having a binary digit "0" to the first scan line SL(1**).

On the other hand, when the first logical element 121-1 receives 4 bits including at least one binary digit "1" from at least one of the first signal line S1, the second signal line S2, the third signal line S3, and the fourth signal line S4, which constitute the signal line group GR connected to the first logical element 121-1, the first logical element 121-1 may output an output signal having a binary digit "1" to the first scan line SL(1).

Thus, when selecting the first scan line SL(1) (e.g., to apply a low signal corresponding to a binary digit of "0"), the applied 4 bits may include binary digits "0," "0," "0," and "0" to the first signal line S1, the second signal line S2, the third signal line S3, and the fourth signal line S4 constituting the signal line group GR connected to the first logical element 121-1. On the other hand, when the first scan line SL(1) is not selected, there may be applied 4 bits, at least one of which including a binary digit "1" to the first signal line S1, the second signal line S2, the third signal line S3, and/or the fourth signal line S4 constituting the signal line group GR connected to the first logical element 121-1.

When a switching transistor included in the pixel circuit 111 is a p-channel metal-oxide semiconductor (PMOS) transistor, a selected switching transistor (i.e., a switching transistor included in the pixel circuit 111 connected to a selected one of the scan lines SL(1) through SL(n)) may be turned on when an output signal having a binary digit "0" is applied to the selected scan line SL(1) through SL(n). Thus, additional components may be omitted in FIG. 3.

On the other hand, when a switching transistor included in the pixel circuit 111 is a n-channel metal-oxide semiconductor (NMOS) transistor, a selected switching transistor (i.e., a switching transistor included in the pixel circuit 111 connected to a selected scan line SL(1) through SL(n)) may be turned off when an output signal having a binary digit "0" is applied to the selected scan line SL(1) through SL(n). Thus, additional components for inverting the output signals of the logical elements 121-1 through **121-*n* may be added to the scan driver shown in FIG. 3. For example, respective inverters may be added to respective outputs of the logical elements 121-1 through 121-*n***.

As described above, the display device 100 may include the scan driver 120 implemented by the decoder-type internal circuit having the structure in which q signal lines S1 through S10 exist, where q is a minimum value that satisfies the combination formula $qCr \geq n$ (here, q denotes the number of the signal lines S1 through S10, n denotes the number of the scan lines SL(1) through SL(n), and r denotes the number of the inputs of each of the logical elements 121-1 through **121-*n*), and some or all of the signal lines S1 through S10 are respectively connected to the logical elements 121-1 through 121-*n*, which are respectively connected to the scan lines SL(1) through SL(n). As a result, the scan driver 120 may efficiently reduce the dead space of the display device 100 by reducing or minimizing the number of the signal lines S1 through S10 located in the non-display region of the display device 100. In addition, because the scan driver 120 is implemented by the decoder-type internal circuit, the scan driver 120 may sequentially drive the scan lines SL(1) through SL(n), or may instead randomly drive the scan lines SL(1) through SL(n). Thus, the q bits of the scan line selection signal may be changed to sequentially drive the scan lines SL(1) through SL(n), or to randomly drive the scan lines SL(1**) through SL(n).

Further, when all q bits of the scan line selection signal have a binary digit "0," all scan lines SL(1) through SL(n) may be selected by the scan driver 120. On the other hand, when all q bits of the scan line selection signal have a binary digit "1," all scan lines SL(1) through SL(n) may be non-selected by the scan driver 120. Thus, the scan driver 120 may drive the scan lines SL(1) through SL(n) based on a simultaneous driving technique. Although it is described above that the scan driver 120 is a component that drives the scan lines SL(1) through SL(n), the scan driver 120 may also be used as an emission driver that drives emission control lines when the display device 100 is an organic light emitting display device. Thus, the scan driver 120 may also be interpreted as a component for driving the emission control lines of the organic light emitting display device.

Figure 4:
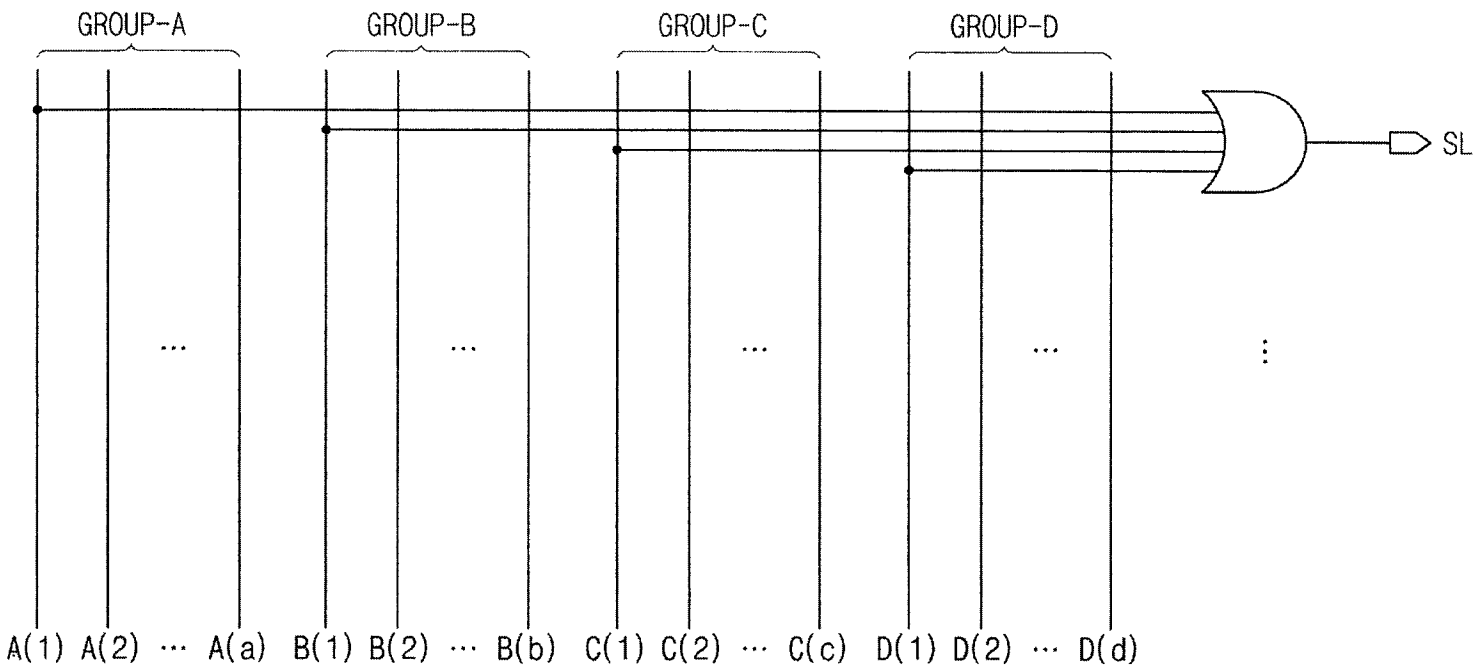
Figure 5:
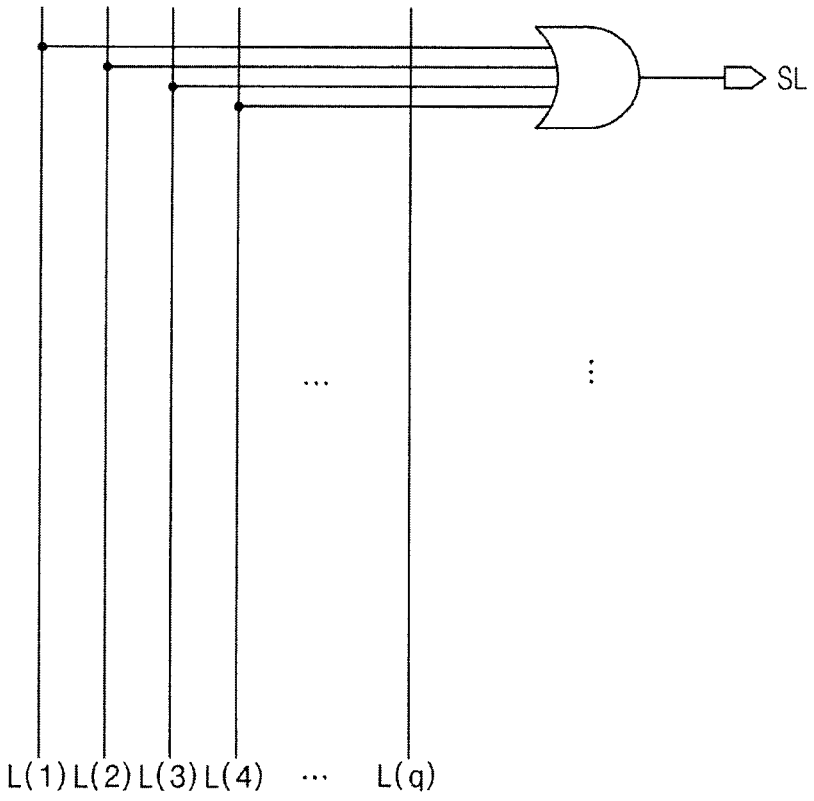

FIGS. 4 through 6 are diagrams for comparing a conventional scan driver with a scan driver included in the display device of FIG. 1.

Referring to FIGS. 4 through 6, a structure of the conventional scan driver and a structure of the scan driver 120 included in the display device 100 are respectively shown in FIGS. 4 and 5. In addition, a difference between the number of signal lines of the conventional scan driver and the number of signal lines of the scan driver 120, due to a structural difference between the conventional scan driver and the scan driver 120, is shown in FIG. 6.

For example, as illustrated in FIG. 4, the conventional scan driver has a structure in which the signal lines A(1) through A(a), B(1) through B(b), C(1) through C(c), and D(1) through D(d) are respectively grouped into signal line groups GROUP-A, GROUP-B, GROUP-C, and GROUP-D. One signal line (e.g., A(1), B(1), C(1), and D(1)) respectively selected from each signal line group GROUP-A, GROUP-B, GROUP-C, and GROUP-D is connected to inputs of one OR-gate element, and an output of the OR-gate element is connected to one scan line SL.

On the other hand, as illustrated in FIG. 5, the scan driver 120 has a structure in which q signal lines L(1) through L(q) exist, where q is a minimum value that satisfies a combination formula $qCr \geq n$ (here, q denotes the number of the signal lines L(1) through L(q), n denotes the number of the scan lines SL, and r denotes the number of inputs of each logical element), and some or all of the signal lines L(1) through L(q) are correspondingly connected to an OR-gate element correspondingly connected to the scan lines SL. As described above, both the conventional scan driver and the scan driver 120 are implemented by a decoder-type internal circuit. However, unlike the conventional scan driver that respectively groups the signal lines A(1) through A(a), B(1) through B(b), C(1) through C(c), and D(1) through D(d) into the signal line groups GROUP-A, GROUP-B, GROUP-C, and GROUP-D to connect the signal lines A(1) through A(a), B(1) through B(b), C(1) through C(c), and D(1) through D(d) to respective OR-gate elements, the scan driver 120 may connect the signal lines L(1) through L(q) to the OR-gate elements based on a combination calculation.

As for the number of the signal lines A(1) through A(a), B(1) through B(b), C(1) through C(c), and D(1) through D(d) of the conventional scan driver, the number of combinations may be calculated by $a \times b \times c \times d$, where a is the number of the signal lines A(1) through A(a) of the signal line group GROUP-A, b is the number of the signal lines B(1) through B(b) of the signal line group GROUP-B, c is the number of the signal lines C(1) through C(c) of the signal line group GROUP-C, and d is the number of the signal lines D(1) through D(d) of the signal line group GROUP-D, because one signal line selected from each signal line group GROUP-A, GROUP-B, GROUP-C, and GROUP-D is connected to inputs of one OR-gate element.

For example, when 200 OR-gate elements exist (i.e., when 200 scan lines SL exist), a, b, c, and d may be determined to be, for example, 5, 5, 2, and 4, respectively, because $a \times b \times c \times d$ should be 200. Similarly, when 256 OR-gate elements exist (i.e., when 256 scan lines SL exist), a, b, c, and d may be determined to be 4, 4, 4, and 4, respectively, because $a \times b \times c \times d$ should be 256. That is, in the conventional scan driver, 16 signal lines A(1) through A(a), B(1) through B(b), C(1) through C(c), and D(1) through D(d) are required in both example cases (i.e., $a+b+c+d=5+5+2+4=16$ and $a+b+c+d=4+4+4+4=16$).

On the other hand, in an embodiment of the present invention, when 200 OR-gate elements exist (i.e., when 200 scan lines SL exist), a minimum value q that satisfies a combination formula $qC4 \geq 200$ may be determined to be 10. Similarly, when 256 OR-gate elements exist (i.e., when 256 scan lines SL exist), a minimum value q that satisfies a combination formula $qC4 \geq 256$ may be determined to be 11. That is, in the scan driver 120, only 10 or 11 signal lines L(1) through L(q) are required under the same conditions as described above with respect to the conventional scan driver. Therefore, the display device 100 including the scan driver 120 may have a BM structure that is improved/reduced by more than 30% when compared to a BM structure of a display device including the conventional scan driver.

FIG. 6 shows a difference between the number of signal lines of the conventional scan driver, and the number of signal lines of the scan driver 120 of an embodiment of the present invention, due to a structural difference between the conventional scan driver and the scan driver 120. For example, assuming that the number of signal lines is 16, the scan driver 120 can maximally drive 1820 scan lines SL (i.e., ${}_{16}C_4=1820$) while the conventional scan driver can maximally drive 256 scan lines SL (i.e., $4 \times 4 \times 4 \times 4=256$).

In addition, assuming that 200 scan lines SL are driven, the scan driver 120 may have only 10 signal lines L(1) through L(q) while the conventional scan driver requires 16 signal lines A(1) through A(a), B(1) through B(b), C(1) through C(c), and D(1) through D(d) (i.e., $a+b+c+d=5+5+2+4=16$ and $a+b+c+d=4+4+4+4=16$). As a result, compared to the conventional scan driver, the scan driver 120 may achieve about 38%-improved effect. Here, the effect indicates a degree to which the scan driver 120 reduces its area, or size, when compared to the conventional scan driver. In this way, the scan driver 120 may achieve about 33%-improved effect compared to the conventional scan driver when 400 scan lines SL are driven, and may achieve about 36%-improved effect compared to the conventional scan driver when 800 scan lines SL are driven. Therefore, the display device 100 including the scan driver 120 may have the BM structure that is improved by more than 30% when compared to the BM structure of the display device including the conventional scan driver.

Figure 7:
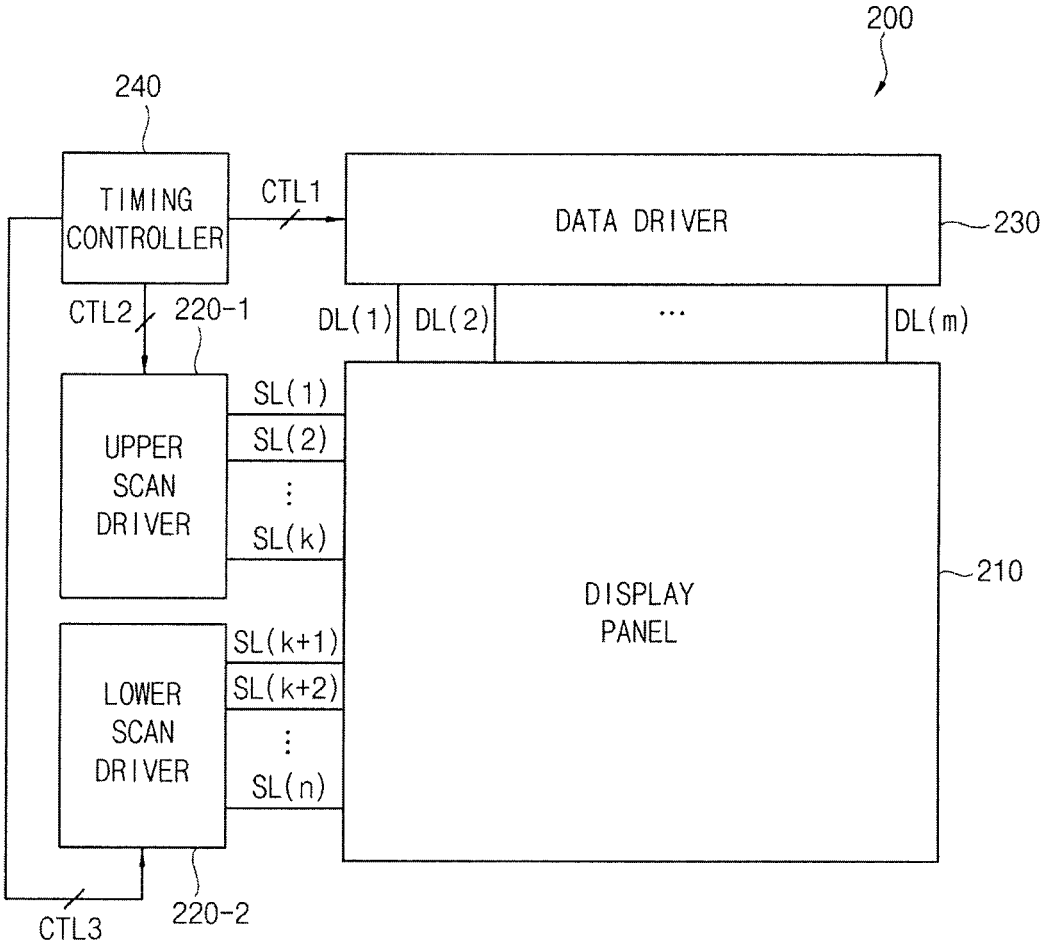
FIG. 7 is a block diagram illustrating a display device according to example embodiments.
Figure 8:
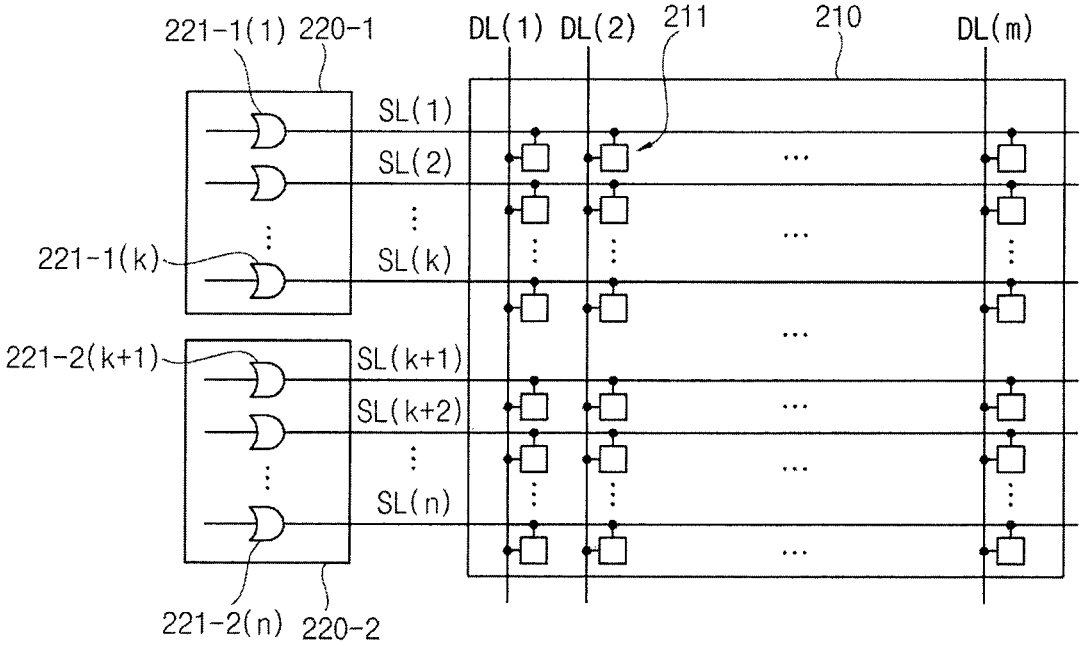
FIG. 8 is a diagram illustrating an example in which a display panel is connected to a scan driver in the display device of FIG. 7.

FIG. 7 is a block diagram illustrating a display device according to example embodiments, and FIG. 8 is a diagram illustrating an example in which a display panel is connected to a scan driver in the display device of FIG. 7.

Referring to FIGS. 7 and 8, the display device 200 may include a display panel 210, an upper scan driver 220-1, a lower scan driver 220-2, a data driver 230, and a timing controller 240. In an example embodiment, the display device 200 may be an organic light emitting display device of which the display panel 210 includes a pixel circuit 211 including an organic light emitting diode. In another example embodiment, the display device 200 may be a liquid crystal display device of which the display panel 210 includes a pixel circuit 211 including a liquid crystal layer. However, the display device 200 is not limited thereto.

The display panel 210 may include a plurality of pixel circuits 211. The upper scan driver 220-1 may provide an upper scan signal to an upper display region of the display panel 210 through upper scan lines SL(1) through SL(k), where k is an integer between 1 and n. The lower scan driver 220-2 may provide a lower scan signal to a lower display region of the display panel 210 through lower scan lines SL(k+1) through SL(n). Here, the upper scan driver 220-1 and the lower scan drier 220-2 might not drive the upper scan lines SL(1) through SL(k) and the lower scan lines SL(k+1) through SL(n) at the same time. For example, using a line counter and the like, the upper scan driver 220-1 may operate when the upper display region of the display panel 210 is driven, and the lower scan driver 220-2 may operate when the lower display region of the display panel 210 is driven. The data driver 230 may provide a data signal to the display panel 210 through data lines DL(1) through DL(m) in response to the upper scan signal and the lower scan signal.

The timing controller 240 may control the data driver 230, the upper scan driver 220-1, and the lower scan driver 220-2 by generating control signals CTL1, CTL2, and CTL3 to respectively provide the control signals CTL1, CTL2, and CTL3 to the data driver 230, the upper scan driver 220-1, and the lower scan driver 220-2. Here, the control signal CTL2 that the timing controller 240 provides to the upper scan driver 220-1 may include an upper scan line selection signal for selecting one target upper scan line among the upper scan lines SL(1) through SL(k). In addition, the control signal CTL3 that the timing controller 240 provides to the lower scan driver 220-2 may include a lower scan line selection signal for selecting one target lower scan line among the lower scan lines SL(k+1) through SL(n).

In some example embodiments, the display device 200 may further include other components. Although it is illustrated in FIG. 7 that the upper scan driver 220-1, the lower scan driver 220-2, the data driver 230, and the timing controller 240 are separated from each other, in some example embodiments, the upper scan driver 220-1, the lower scan driver 220-2, the data driver 230, and the timing controller 240 may be integrated into a single component in the display device 200. Thus, the upper scan driver 220-1, the lower scan driver 220-2, the data driver 230, and the timing controller 240 may be interpreted as functions of at least one peripheral circuit connected to the display panel 210. For example, the timing controller 240 may perform operations of the upper scan driver 220-1, the lower scan driver 220-2, and the data driver 230, or may include at least one component that performs the operations of the upper scan driver 220-1, the lower scan driver 220-2, and the data driver 230.

The upper scan driver 220-1 may include upper signal lines and upper logical elements 221-1(1) through 221-1(*k*), and the lower scan driver 220-2 may include lower signal lines and lower logical elements 221-2(*k*+1) through 221-2(*n*). In addition, as illustrated in FIG. 8, the upper logical elements 221-1(1) through 221-1(*k*) of the upper scan driver 220-1 may be respectively connected to the upper scan lines SL(1) through SL(k), and the lower logical elements 221-2(*k*+1) through 221-2(*n*) of the lower scan driver 220-2 may be respectively connected to the lower scan lines SL(k+1) through SL(n).

The upper signal lines of the upper scan line 220-1 may transfer the upper scan line selection signal for selecting one target upper scan line among the upper scan lines SL(1) through SL(k). The upper logical elements 221-1(1) through 221-1(*k*) of the upper scan driver 220-1 may be correspondingly connected to some or all of upper signal line groups (similar to the signal line groups GR shown in FIG. 3) into which the upper signal lines are grouped based on a combination calculation. The upper logical elements 221-1(1) through 221-1(*k*) of the upper scan driver 220-1 may be respectively connected to the upper scan lines SL(1) through SL(k). Thus, the upper logical elements 221-1(1) through 221-1(*k*) of the upper scan driver 220-1 may provide an upper output signal to the upper scan lines SL(1) through SL(k) as the upper scan signal. Here, because the upper scan driver 220-1 is required to drive the upper scan lines SL(1) through SL(k) of the display device 200, the number of the upper signal line groups may be greater than or equal to the number of the upper logical elements 221-1(1) through 221-1(*k*).

The lower signal lines of the lower scan line 220-2 may transfer the lower scan line selection signal for selecting one target lower scan line among the lower scan lines SL(k+1) through SL(n). The lower logical elements 221-2(*k*+1) through 221-2(*n*) of the lower scan driver 220-2 may be correspondingly connected to some or all of lower signal line groups (similar to the signal line groups GR shown in FIG. 3) into which the lower signal lines are grouped based on a combination calculation. The lower logical elements 221-2(*k*+1) through 221-2(*n*) of the lower scan driver 220-2 may be correspondingly connected to the lower scan lines SL(k+1) through SL(n). Thus, the lower logical elements 221-2(*k*+1) through 221-2(*n*) of the lower scan driver 220-2 may provide a lower output signal to the lower scan lines SL(k+1) through SL(n) as the lower scan signal. Here, because the lower scan driver 220-2 is required to drive the lower scan lines SL(k+1) through SL(n) of the display device 200, the number of the lower signal line groups may be greater than, or equal to, the number of the lower logical elements 221-2(*k*+1) through 221-2(*n*).

For example, in the upper scan driver 220-1, the number of the upper signal lines may be a minimum value q1 that satisfies a combination formula $q_1Cr_1 \geq n1$, where q1 denotes the number of the upper signal lines, n1 denotes either the number of the upper scan lines SL(1) through SL(k) or the number of the upper logical elements 221-1(1) through 221-1(*k*), and r1 denotes the number of inputs of each of the upper logical elements 221-1(1) through 221-1(*k*).

In addition, in the lower scan driver 220-2, the number of the lower signal lines may be a minimum value q2 that satisfies a combination formula $q_2Cr_2 \geq n2$, where q2 denotes the number of the lower signal lines, n2 denotes either the number of the lower scan lines SL(k+1) through SL(n) or the number of the lower logical elements 221-2(*k*+1) through 221-2(*n*), and r2 denotes the number of inputs of each of the lower logical elements 221-2(*k*+1) through 221-2(*n*).

In an example embodiment, the number of the upper scan lines SL(1) through SL(k) may be equal to the number of the lower scan lines SL(k+1) through SL(n). In this case, the number of the upper signal lines of the upper scan driver 220-1 may be equal to the number of the lower signal lines of the lower scan driver 220-2. In another example embodiment, the number of the upper scan lines SL(1) through SL(k) may be different from the number of the lower scan lines SL(k+1) through SL(n). In this case, the number of the upper signal lines of the upper scan driver 220-1 may be different from the number of the lower signal lines of the lower scan driver 220-2.

For example, when the number of the scan lines SL(1) through SL(n) is 200, when the number of the inputs of each logical element 221-1(1) through 221-2(*n*) is 4, and when the number of the upper scan lines SL(1) through SL(k) is equal to the number of the lower scan lines SL(k+1) through SL(n), then the minimum value q1 that satisfies a combination formula g1C4≥100 and the minimum value q2 that satisfies a combination formula q2C4≥100 can be obtained. In this case, because q1C4 and q2C4 are 70 when q1 and q2 are 8, and because q1C4 and q2C4 are 126 when q1 and q2 are 9, the minimum value q1 and the minimum value q2 may be determined to be 9. That is, nine signal lines (i.e., the upper signal lines) may be arranged in the upper scan driver 220-1, and nine signal lines (i.e., the lower signal lines) may be arranged in the lower scan driver 220-2. Thus, the display device 200 in which a scan driver is divided into the upper scan driver 220-1 and the lower scan driver 220-2 may have an improved (e.g., reduced or more slim) BM structure when compared to the display device 100 of FIG. 1.

The upper scan line selection signal may include q1 bits. The upper signal lines may transfer the q1 bits. Each of the upper logical elements 221-1(1) through 221-1(*k*) may generate the upper output signal by performing a logical operation on r1 bits transferred from each upper signal line group. The lower scan line selection signal may include q2 bits. The lower signal lines may transfer the q2 bits. Each of the lower logical elements 221-2(*k*+1) through 221-2(*n*) may generate the lower output signal by performing a logical operation on r2 bits transferred from each lower signal line group.

In an example embodiment, as illustrated in FIG. 8, the logical elements 221-1(1) through 221-2(*n*) may be OR-gate elements. In this case, when an upper output signal of one of the upper logical elements 221-1(1) through 221-1(*k*) has a binary digit "0," an upper scan line SL(1) through SL(k) connected to a respective one of the upper logical elements 221-1(1) through 221-1(*k*) may be selected by the upper scan driver 220-1. On the other hand, when an upper output signal of an upper logical element 221-1(1) through 221-1(*k*) has a binary digit "1," an upper scan line SL(1) through SL(k) connected to the upper logical element 221-1(1) through 221-1(*k*) might not be selected by the upper scan driver 220-1.

In addition, when a lower output signal of one of the lower logical elements 221-2(*k*+1) through 221-2(*n*) has a binary digit "0," a lower scan line SL(k+1) through SL(n) connected to a respective one of the lower logical elements 221-2(*k*+1) through 221-2(*n*) may be selected by the lower scan driver 220-2. On the other hand, when a lower output signal of a lower logical element 221-2(*k*+1) through 221-2(*n*) has a binary digit "1," a lower scan line SL(k+1) through SL(n) connected to the lower logical element 221-2(*k*+1) through 221-2(*n*) might not be selected by the lower scan driver 220-2.

Because the scan drivers 220-1 and 220-2 are implemented by the decoder-type internal circuits, the scan drivers 220-1 and 220-2 may sequentially drive the scan lines SL(1) through SL(n), or may randomly drive the scan lines SL(1) through SL(n). Thus, the q1 bits of the upper scan line selection signal and the q2 bits of the lower scan line selection signal may be changed to sequentially drive the scan lines SL(1) through SL(n), or to randomly drive the scan lines SL(1) through SL(n). Although it is described above that the scan drivers 220-1 and 220-2 are components that drive the scan lines SL(1) through SL(n), the scan drivers 220-1 and 220-2 may each also be used as an emission driver that drives emission control lines when the display device 200 is an organic light emitting display device. Thus, the scan drivers 220-1 and 220-2 may also be interpreted as components for driving the emission control lines of the organic light emitting display device.

Figure 9:
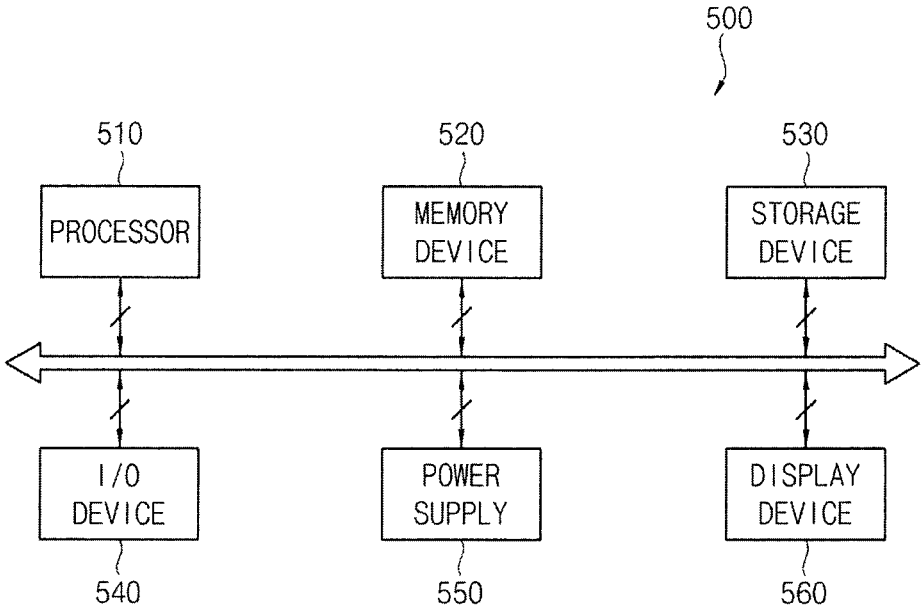
FIG. 9 is a block diagram illustrating an electronic device according to example embodiments.
Figure 10A:
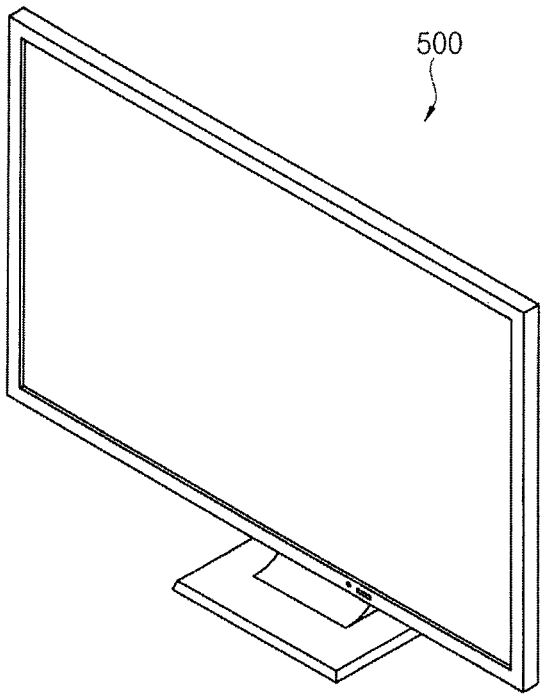
FIG. 10A is a perspective view illustrating an example in which the electronic device of FIG. 9 is implemented as a television.
Figure 10B:
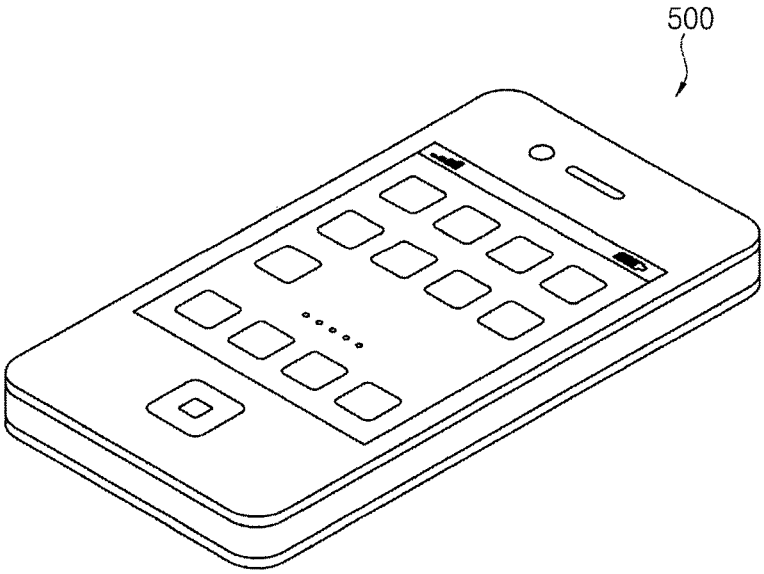
FIG. 10B is a perspective view illustrating an example in which the electronic device of FIG. 9 is implemented as a smart phone.

FIG. 9 is a block diagram illustrating an electronic device according to example embodiments, FIG. 10A is a perspective view illustrating an example in which the electronic device of FIG. 9 is implemented as a television, and FIG. 10B is a perspective view illustrating an example in which the electronic device of FIG. 9 is implemented as a smart phone.

Referring to FIGS. 9, 10A, and 10B, the electronic device 500 may include a processor 510, a memory device 520, a storage device 530, an input/output (I/O) device 540, a power supply 550, and a display device 560. Here, the display device 560 may be the display device 100 of FIG. 1, or may be the display device 200 of FIG. 7. In addition, the electronic device 500 may further include a plurality of ports for communicating, a video card, a sound card, a memory card, a universal serial bus (USB) device, other electronic devices, etc. In an example embodiment, as illustrated in FIG. 10A, the electronic device 500 may be implemented as a television or monitor. In another example embodiment, as illustrated in FIG. 10B, the electronic device 500 may be implemented as a smart phone. However, the electronic device 500 is not limited thereto. For example, the electronic device 500 may be implemented as a cellular phone, a video phone, a smart pad, a smart watch, a tablet PC, a car navigation system, a computer monitor, a laptop, a head mounted display (HMD), a game console, etc.

The processor 510 may perform various computing functions. The processor 510 may be a microprocessor, a central processing unit (CPU), an application processor (AP), etc. The processor 510 may be coupled to other components via an address bus, a control bus, a data bus, etc. Further, the processor 510 may be coupled to an extended bus, such as a peripheral component interconnection (PCI) bus.

The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 530 may include a solid state drive (SSD) device, a hard disk drive (HDD) device, a CD-ROM device, etc. The I/O device 540 may include an input device such as a keyboard, a keypad, a touchpad, a touch-screen, a mouse device, etc., and an output device such as a printer, a speaker, etc. The power supply 550 may provide power for operations of the electronic device 500.

The display device 560 may communicate with other components via the buses or other communication links. In some example embodiments, the display device 560 may be included in the I/O device 540. For example, the display device 560 may be an organic light emitting display device or a liquid crystal display device. However, the display device 560 is not limited thereto. As described above, the display device 560 may have a slim BM structure by including a scan driver implemented by a decoder-type internal circuit that can reduce a dead space of the display device 560 by reducing (or, minimizing) the number of signal lines located in a non-display region of the display device 560.

For example, the scan driver may be implemented by the decoder-type internal circuit having a structure in which q signal lines exist, where q is a minimum value that satisfies a combination formula $qCr \geq n$ (here, q denotes the number of signal lines, n denotes the number of scan lines, and r denotes the number of inputs of each logical element), and some or all of the signal lines are correspondingly connected to logical elements that are correspondingly connected to the scan lines. In an example embodiment, the display device 560 may include a display panel, a scan driver that provides a scan signal to the display panel through the scan lines, a data driver that provides a data signal to the display panel through the data lines in response to the scan signal, and a timing controller that controls the scan driver and the data driver. Here, the scan driver may include signal lines and logical elements. The signal lines may transfer a scan line selection signal for selecting one target scan line among the scan lines. The logical elements may be correspondingly connected to some or all of signal line groups into which the signal lines are grouped based on combination calculation. The logical elements may be correspondingly connected to the scan lines. The logical elements may provide respective output signals to the scan lines as the scan signal. In example embodiments, the number of the signal line groups may be greater than or equal to the number of the logical elements.

In another example embodiment, in a manner similar to the display device 200 shown in FIG. 7, the display device 560 may include a display panel having an upper display region and a lower display region, an upper scan driver that provides an upper scan signal to the upper display region through upper scan lines, a lower scan driver that provides an lower scan signal to the lower display region through lower scan lines, a data driver that provides a data signal to the display panel through the data lines in response to the upper scan signal and the lower scan signal, and a timing controller that controls the upper scan driver, the lower scan driver, and the data driver.

Here, the upper scan driver may include upper signal lines and upper logical elements. The upper signal lines may transfer an upper scan line selection signal for selecting one target upper scan line among the upper scan lines. The upper logical elements may be correspondingly connected to some or all of upper signal line groups into which the upper signal lines are grouped based on a combination calculation. The upper logical elements may be correspondingly connected to the upper scan lines. The upper logical elements may provide respective upper output signals to the upper scan lines as the upper scan signal. In example embodiments, the number of the upper signal line groups may be greater than or equal to the number of the upper logical elements.

In addition, the lower scan driver may include lower signal lines and lower logical elements. The lower signal lines may transfer a lower scan line selection signal for selecting one target lower scan line among the lower scan lines. The lower logical elements may be correspondingly connected to some or all of lower signal line groups into which the lower signal lines are grouped based on a combination calculation. The lower logical elements may be correspondingly connected to the lower scan lines. The lower logical elements may provide respective lower output signals to the lower scan lines as the lower scan signal. In example embodiments, the number of the lower signal line groups may be greater than or equal to the number of the lower logical elements. Because these elements are described above, duplicated description will not be repeated.

The present inventive concept may be applied to a display device, and an electronic device including the display device. For example, the present inventive concept may be applied to a cellular phone, a smart phone, a video phone, a smart pad, a smart watch, a tablet PC, a car navigation system, a television, a computer monitor, a laptop, a head mounted display, a game console, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A scan driver comprising:

a plurality of signal lines configured to transfer a scan line selection signal for selecting a target scan line among a plurality of scan lines; and a plurality of OR-gate elements respectively connected to some or all of a plurality of signal line groups respectively comprising grouped ones of the signal lines based on a combination calculation, the plurality of OR-gate elements being respectively connected to the scan lines, and being configured to provide output signals to the scan lines, wherein a number of the signal line groups is greater than, or equal to, a number of the OR-gate elements, wherein a number of the signal lines corresponds to a combination formula $qCr \geq n$, wherein q denotes the number of the signal lines and is a minimum integer value that satisfies the combination formula $qCr \geq n$, wherein n denotes a number of the scan lines or the number of the OR-gate elements, and wherein r is greater than 3, and denotes a number of inputs of each of the OR-gate elements.

2. The scan driver of claim 1, wherein the scan line selection signal comprises q bits, wherein the signal lines are configured to transfer the q bits, and wherein each of the OR-gate elements are configured to generate each of the output signals by performing a logical operation on r bits transferred from each of the signal line groups.

3. The scan driver of claim 2, wherein a corresponding scan line of the scan lines connected to a corresponding OR-gate element of the OR-gate elements is configured to be selected when a corresponding output signal of the output signals of the corresponding OR-gate element comprises a binary digit "0," and wherein the corresponding scan line is configured to be not selected when the corresponding output signal comprises a binary digit "1".

4. The scan driver of claim 3, wherein the q bits of the scan line selection signal are configured to be changed to sequentially drive the scan lines, or to randomly drive the scan lines.

5. A display device comprising:

a display panel;

a scan driver configured to provide a scan signal to the display panel via a plurality of scan lines;

a data driver configured to provide a data signal to the display panel via a plurality of data lines in response to the scan signal; and a timing controller configured to control the scan driver and the data driver, wherein the scan driver comprises:

a plurality of signal lines configured to transfer a scan line selection signal for selecting a target scan line among the scan lines; and a plurality of OR-gate elements respectively connected to some or all of a plurality of signal line groups comprising grouped ones of the signal lines based on a combination calculation, the plurality of OR-gate elements being respectively connected to the scan lines, and being configured to provide output signals to the scan lines as the scan signal, wherein a number of the signal line groups is greater than or equal to a number of the OR-gate elements, wherein a number of the signal lines corresponds to a combination formula $qCr \geq n$, wherein q denotes the number of the signal lines and is a minimum integer value that satisfies the combination formula $qCr \geq n$, wherein n denotes a number of the scan lines or the number of the OR-gate elements, and wherein r is greater than 3, and denotes a number of inputs of each of the OR-gate elements.

6. The display device of claim 5, wherein the scan line selection signal comprises q bits, wherein the signal lines are configured to transfer the q bits, and wherein each of the OR-gate elements is configured to generate a corresponding output signal of the output signals by performing a logical operation on r bits transferred from a corresponding signal line group of the signal line groups.

7. The display device of claim 6, wherein a corresponding scan line of the scan lines that is connected to a corresponding OR-gate element of the OR-gate elements is configured to be selected when the corresponding output signal of the corresponding OR-gate element comprises a binary digit "0," and wherein the corresponding scan line is configured to be not selected when the corresponding output signal comprises a binary digit "1".

8. The display device of claim 7, wherein the q bits of the scan line selection signal are configured to be changed to sequentially drive the scan lines, or to randomly drive the scan lines.

* * * * *